US009010486B2

(12) United States Patent
Andre et al.

(10) Patent No.: US 9,010,486 B2
(45) Date of Patent: Apr. 21, 2015

(54) SILENCER AND A METHOD FOR PRODUCING SAME

(75) Inventors: Joachim Andre, Elm-Sprengen (DE); Norbert Schug, Herschweiler-Pettersheim (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 14/124,405

(22) PCT Filed: May 14, 2012

(86) PCT No.: PCT/EP2012/058918

§ 371 (c)(1),
(2), (4) Date: Dec. 6, 2013

(87) PCT Pub. No.: WO2012/168039

PCT Pub. Date: Dec. 13, 2012

(65) Prior Publication Data

US 2014/0116801 A1 May 1, 2014

(30) Foreign Application Priority Data

Jun. 8, 2011 (DE) ..... 10 2011 077 183

(51) Int. Cl.

| | |
|---|---|
| ***F01N 1/08*** | (2006.01) |
| ***F01N 1/10*** | (2006.01) |
| ***F01N 13/18*** | (2010.01) |

(52) U.S. Cl.

CPC *F01N 1/08* (2013.01); *F01N 1/089* (2013.01); *F01N 1/10* (2013.01); *F01N 13/1888* (2013.01); *F01N 2470/14* (2013.01); *F01N 2470/18* (2013.01); *F01N 2490/06* (2013.01)

(58) Field of Classification Search

CPC ..... F01N 1/08
USPC ..... 181/268, 227, 228
See application file for complete search history.

(56) References Cited

U.S. PATENT DOCUMENTS

| | | | | |
|---|---|---|---|---|
| 1,715,630 A | | 6/1929 | Snell | |
| 3,388,769 A | * | 6/1968 | Martoia | 181/238 |
| 3,776,366 A | * | 12/1973 | Betts et al. | 181/239 |
| 4,203,502 A | * | 5/1980 | Strader | 181/238 |
| 4,913,260 A | * | 4/1990 | Fallon | 181/254 |

(Continued)

FOREIGN PATENT DOCUMENTS

| | | |
|---|---|---|
| DE | 38 36 589 A1 | 5/1990 |
| DE | 10 2008 032 765 A1 | 2/2009 |

(Continued)

*Primary Examiner* — Forrest M Phillips
(74) *Attorney, Agent, or Firm* — McGlew and Tuttle, P.C.

(57) ABSTRACT

A silencer (1) for an exhaust gas installation of an internal combustion engine, particularly of a motor vehicle includes a housing (2), with a circumferential shell (3) closed in the peripheral direction (5) and an end base (6) at each of two longitudinal ends, spaced apart in an axial direction (4). A silencer insert (15) is arranged in the housing (2) and has an inlet pipe (8) for exhaust gas and an outlet pipe (10) for exhaust gas. The shell (3) has, in the peripheral direction (5) has at least one inlet shell-segment (11) and one outlet shell-segment (12). The inlet shell-segment has at least one inlet opening (7), into which such an inlet pipe (8) is inserted from the inside. The outlet shell-segment (12) has at least one outlet opening (9) into which such an outlet pipe (10) is inserted from the inside.

18 Claims, 4 Drawing Sheets

(56) References Cited

U.S. PATENT DOCUMENTS

| | | | | |
|---|---|---|---|---|
| 5,373,119 | A | 12/1994 | Suzuki et al. | |
| 7,878,300 | B2 | 2/2011 | Sammut et al. | |
| 8,292,026 | B2 * | 10/2012 | Tauschek et al. | 181/251 |
| 8,661,795 | B2 * | 3/2014 | Eavenson, Sr. | 60/299 |
| 2009/0000282 | A1 * | 1/2009 | Gruber | 60/299 |
| 2009/0032332 | A1 | 2/2009 | Reuther et al. | |
| 2009/0101434 | A1 * | 4/2009 | Sammut et al. | 181/227 |
| 2010/0116586 | A1 | 5/2010 | Andre et al. | |
| 2013/0153329 | A1 * | 6/2013 | Bischel et al. | 181/228 |

FOREIGN PATENT DOCUMENTS

| | | | |
|---|---|---|---|
| DE | 10 2008 056 350 | A1 | 7/2010 |
| JP | S49-57234 | A | 6/1974 |
| JP | S51-46844 | U | 4/1976 |
| JP | 2006-342679 | A | 12/2006 |

* cited by examiner

SILENCER AND A METHOD FOR PRODUCING SAME

CROSS REFERENCE TO RELATED APPLICATIONS

This application is a United States National Phase Application of International Application PCT/EP2012/058918 filed May 14, 2012 and claims the benefit of priority under 35 U.S.C. §119 of German Patent Application DE 10 2011 077 183.2 filed Jun. 8, 2011, the entire contents of which are incorporated herein by reference.

FIELD OF THE INVENTION

The present invention relates to a silencer (also known as a muffler) for an exhaust system of an internal combustion engine, in particular of a motor vehicle, having a shell housing with an insert. The invention additionally relates to a method for producing such a silencer.

BACKGROUND OF THE INVENTION

Silencers can be produced or configured in different ways. In a shell design, at least two shell bodies are fastened to one another in order to form a silencer housing. Inlet pipes and outlet pipes are then fed through the shell bodies or fed through connecting regions of the shell bodies. In the case of a tubular design, a silencer insert is axially inserted into a tubular housing. The tubular housing is closed off through two end bases at its axial face ends Inner pipes and outlet pipes are practically fed through the end bases. However, if it is required to route such a tube through the tubular body, i.e. through the shell of the housing, connecting the respective pipe to the silencer insert in the interior of the housing results in considerable complications. In the case of a wrap design, a unit of silencer insert and end bases is preassembled and subsequently wrapped with a sheet metal body in order to form the shell of the housing. Insofar as a shell lead-through for one of the pipes is required in this case, the relevant lead-through opening can already be prepared on the plate body, wherein the wrapping of the silencer insert then takes place starting out from this passage opening.

A modification of the wrap design follows from DE 10 2008 056 350 A1, which discloses a silencer whose housing comprises a closed circumferential shell in circumferential direction and an end base each on two longitudinal ends that are distant from one another and whose silencer insert is arranged in the housing and comprises at least one inlet pipe for exhaust gas and at least one outlet pipe for exhaust gas. The shell is now segmented in the circumferential direction, so that it comprises exactly two shell segments. The one shell segment contains an opening, into which one of the pipes is inserted from inside. For the production, the shell segment equipped with the opening is attached to a unit which is formed out of the silencer insert and the two end bases. Following this, the other shell segment, which does not contain an opening, is fitted radially with respect to the axial direction of the silencer, wherein this shell segment engages about the unit consisting of end bases and silencer insert largely in the circumferential direction. The circumferential ends of the two shell segments are then joined together in order to close off the shell in a gas-tight manner. In addition to this, the end bases are joined to the shell segments in a gas-tight manner. In the case of the known silencer, at least one further pipe is fed through one of the end bases, for the purpose of which the respective end base comprises a corresponding passage opening.

SUMMARY OF THE INVENTION

The present invention now deals with the problem of improving or at least providing another embodiment for a silencer of the type mentioned at the outset, which is characterized in particular by a simplified producibility. In particular, a particularly compact arrangement of the silencer within an exhaust system, preferably within a vehicle, is to be realizable.

The invention is based on the general idea of segmenting the shell in the circumferential direction so that at least two shell segments are created, namely an inlet shell segment and an outlet shell segment. Inlet shell segment and outlet shell segment are practically separately produced components. The inlet shell segment comprises at least one inlet opening, wherein an inlet pipe is inserted into the respective inlet opening from the inside. The outlet shell segment comprises at least one outlet opening, wherein an outlet pipe is inserted into the respective outlet opening from the inside. The inlet opening penetrates the shell or the inlet shell segment in radial direction. The outlet opening penetrates the shell or the outlet shell segment in radial direction. Through the proposed design it is thus possible to feed the inlet pipe or inlet pipes through the inlet shell segment and the outlet pipe or outlet pipes through the outlet shell segment, i.e. through the shell so that in principle all gas-carrying connections can be fed through the shell. This produces a simplified configuration for the end bases. Because of this it is likewise possible to design the end bases entirely independently of the silencer insert, so that with end bases remaining the same, different silencer inserts can be used. However, this design is particularly advantageous for accommodating the silencer on the vehicle, since it requires comparatively little installation space.

In this case, the silencer insert is arranged in an interior of the housing, which in the circumferential direction is limited by the shell and in the axial direction by the two end bases.

Accordingly, an embodiment is preferred in which all inlet pipes and all outlet pipes of the silencer insert are inserted into such inlet openings and outlet openings from the inside. In other words, the two end bases can be configured completely closed, i.e. be designed without opening.

In another advantageous embodiment, the respective inlet pipe can be angled L-shaped, wherein a first leg of the respective inlet pipe is inserted into the respective inlet opening, while a second leg of the respective inlet pipe is rotatably arranged about its longitudinal center axis on the silencer insert, for example on an intermediate base of the silencer insert. Additionally or alternatively, the respective outlet pipe can be angled L-shaped, wherein a first leg of the respective outlet pipe is inserted into the respective outlet pipe while a second leg of the respective outlet pipe is rotatably arranged about its longitudinal center axis on the silencer insert, in particular on an intermediate base of the silencer insert. Practically, the respective longitudinal center axis of the respective second leg substantially extends parallel to the axial direction of the silencer. Because of this, it is particularly easily possible during the assembly of the silencer to offset production-related position tolerances. The rotatable arrangement of the respective pipe on the silencer insert can be realizable for example via a sliding seat.

In another advantageous embodiment, the at least one inlet opening can be located diametrically opposite the at least one outlet opening. Because of this, the assembly of the silencer can be substantially simplified. For example, the silencer insert can be inserted into the outlet shell segment, wherein the respective outlet pipe is insertable into the respective outlet opening. Following this, the inlet shell segment can be attached, wherein the receptive inlet pipe can be inserted in the respective inlet opening.

In another advantageous embodiment it can be provided that at least one of the end bases has a curvature orientated towards the outside, which in the housing limits an additional volume, which axially enlarges an interior of the housing. The outwardly convex curvature in this case can be configured funnel shaped or conically. With the help of such a curved end base, installation space which is available in axial direction if applicable can be better utilized for enlarging the volume of the interior. In particular, the volume of the housing can be axially enlarged beyond the region enclosed by the shell because of this, so that the respective additional volume is located axially outside the shell.

Practically, the shell has exactly two shell segments in the circumferential direction, namely only the inlet shell segment and the outlet shell segment. Because of this, the number of the connecting points is reduced to a minimum. In principle, however, an embodiment having three or more shell segments is also possible.

Provided that only two shell segments are provided, the two shell segments can be fastened to one another in the region of their circumferential ends. For example, these circumferential ends can run linearly and parallel to the axial direction of the housing. Additionally or alternatively, the two shell segments can radially overlap in the region of their circumferential ends. In particular, the one shell segment can be radially inserted into the other shell segment. For example, the circumferential ends of the one shell segment can be angled or stepped for this purpose in order to form a slide-in opening or groove radially between the respective shell segment and the end bases and if applicable at least one intermediate base of the silencer insert, into which the circumferential ends of the other shell segment can then be inserted or introduced in the circumferential direction in the manner of a key. For example, a slot and key plug connection can be realized in this way, which can be closed off in a gas-tight manner particularly easily.

In another advantageous embodiment, the silencer insert can comprise two intermediate bases. The intermediate bases can significantly stiffen the shell. In particular, the intermediate bases are configured congruently with the end bases in the axial direction, so that they lie with their outer contour against the inner contour of the shell, in particular in a flat manner. The first intermediate base can axially delimit a first chamber with the first end bottom, which chamber is formed in the interior of the housing. Furthermore, the first intermediate base can axially delimit a second chamber with the second intermediate base, which second chamber thus axially follows the first chamber in the interior of the housing. Furthermore, the second intermediate base can axially delimit a third chamber with the second end base, which third chamber is arranged in the interior of the housing and axially follows the second chamber. Practically, the at least one inlet pipe can now run through the second chamber and passing through the first intermediate bottom be fluidically connected to the first chamber. Additionally or alternatively, the respective outlet pipe can be fluidically connected to the first chamber through the third chamber, passing through the second intermediate bottom, through the second chamber and passing through the first intermediate base. Inlet pipe and outlet pipe thus open into the first chamber, as a result of which the silencer has a comparatively low through-flow resistance.

According to advantageous embodiments, the silencer insert can comprise at least one connecting pipe which extends through the second chamber and which is fluidically connected passing through at least one of the intermediate bases to at least one of the other chambers, i.e. to the first chamber and/or to the third chamber. Because of this the third chamber for example can serve as resonance chamber, in particular for realizing a Helmholtz resonator.

Additionally or alternatively, the at least one inlet pipe and/or the at least one outlet pipe and/or the at least one connecting pipe can be perforated in the second chamber. Because of this, the second chamber can be utilized as an absorption chamber. In particular, the second chamber can be filled with a sound absorption means for this purpose. The at least one outlet pipe can furthermore be perforated in the third chamber, so that the third chamber can also be utilized for example as absorption chamber. To this end, the third chamber can be filled with a sound absorption means.

Particularly practical is a configuration, in which the one shell segment extends over more than 180° in the circumferential direction. Preferentially, this relates to the outlet shell segment.

According to a particularly advantageous embodiment, the silencer possesses exactly one inlet pipe and exactly two outlet pipes, wherein associated outlet openings are positioned on the shell diametrically located opposite the inlet opening.

Producing the silencer introduced here is practically performed in such a manner that the silencer insert is radially inserted into the outlet shell segment, wherein the at least one outlet pipe is inserted into the at least one outlet opening from the inside. Following this, the inlet shell segment is radially attached to the outlet shell segment, wherein the at least one inlet pipe is inserted into the at least one inlet opening from the inside. Alternatively, it is likewise possible that the silencer insert is radially inserted into the inlet shell segment, wherein the at least one inlet pipe is inserted into the at least one inlet opening from the inside. Following this, the outlet shell segment is radially attached to the inlet shell segment, wherein the at least one outlet pipe is inserted into the at least one outlet opening from the inside.

The inlet bases can now be attached before or after the attachment of the inlet shell segment. For example, the inlet bases can be axially attached to the outlet shell segment before the attaching of the inlet shell segment. Alternatively, the inlet bases can be axially attached to the shell after the attaching of the inlet shell segment. According to another embodiment, the end bases can form an integral part of the silencer insert, so that the silencer insert is inserted into the outlet shell segment with the end bases.

The end bases are joined to the shell in a gas-tight manner. The shell segments are joined to one another in a gas-tight manner. The pipes are joined to the shell in the openings in a gas-tight manner. For example, the respective shell opening can be surrounded by a collar for this purpose. The respective collar in this case can radially project to the outside and be configured for example in the manner of a passage.

The shell segments, i.e. in particular the inlet shell segment and the outlet shell segment are each practically produced from one piece, as a result of which they can be realized particularly cost-effectively.

The at least two shell segments are practically produced from the same materials and in particular with same wall thicknesses. In another embodiment it can be provided however that inlet shell segment and outlet shell segment are produced with different wall thicknesses and/or from different materials.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
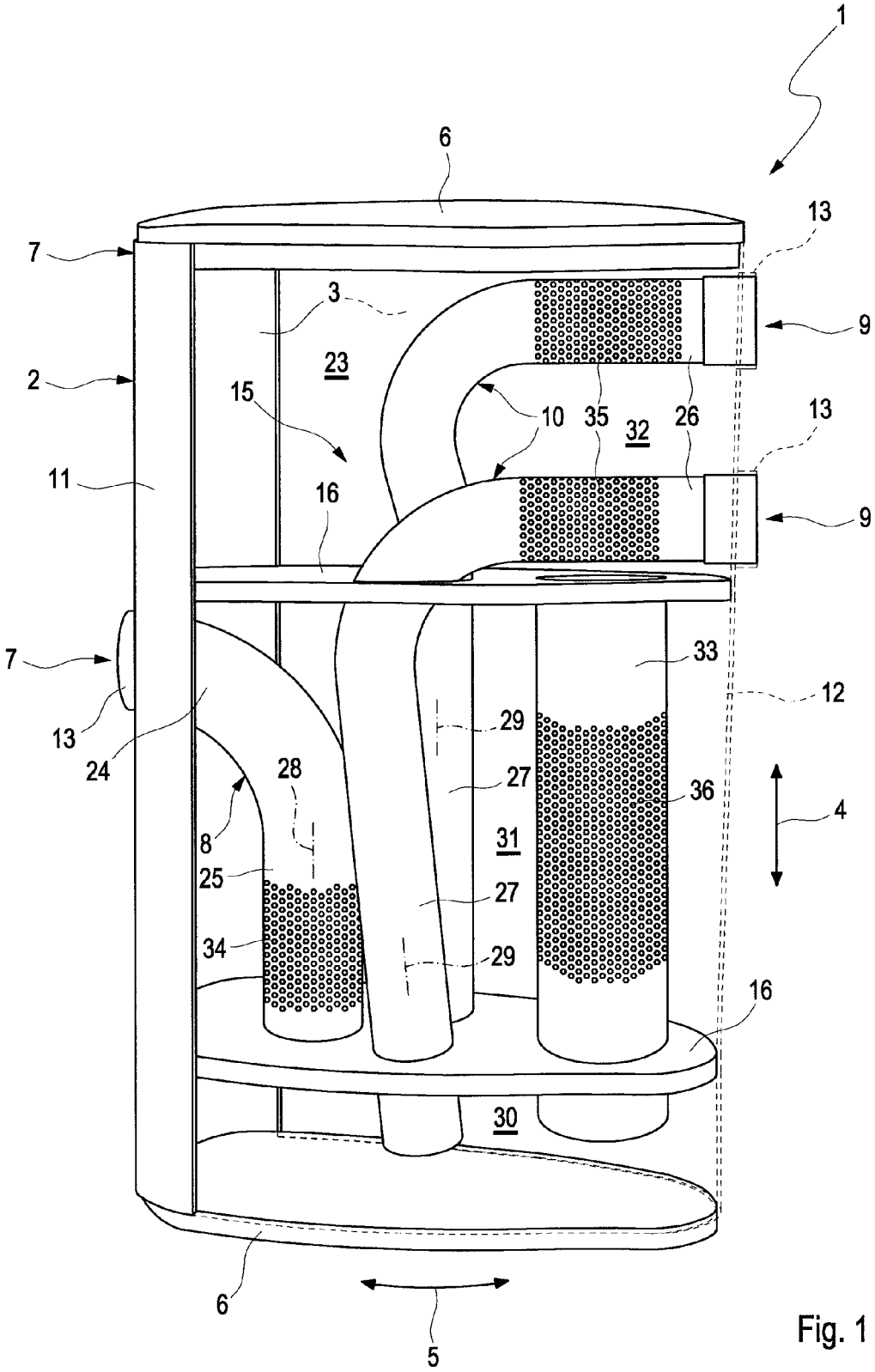
FIG. 1 is a perspective view of a silencer with transparently shown outlet shell segment.

Referring to the drawings in particular, according to FIGS. 1 to 7, a silencer 1, which is suitable for incorporation into an exhaust system of an internal combustion engine, in particular of a motor vehicle, which is not shown here, comprises a housing 2 in shell design. Accordingly, the housing 2 comprises a shell 3 which extends in a longitudinal direction or axial direction 4 and in a circumferential direction 5. The housing 2 furthermore comprises two end bases 6, which are arranged on two longitudinal ends of the shell 3 spaced from one another. Practically, the silencer 1 is configured as a rear silencer, which is suitable in particular for a crosswise assembly on the underfloor of the vehicle.

The housing 2 comprises at least one inlet opening 7 penetrating the shell 3, through which an inlet pipe 8 arranged in the interior 23 of the housing 2 can be connected to a pipe of the exhaust system which is not shown here. The housing 2 comprises at least one outlet opening 9, which in the silencer 1 introduced here is likewise formed in the shell 3. Through this at least one outlet opening 9, an outlet pipe 10 arranged in the interior 23 of the housing 2 can be connectable to a corresponding other pipe of the exhaust system. In the example of FIG. 1, two such outlet openings 9 are provided. Accordingly, two outlet pipes 10 are also provided in this case. In the example of the FIGS. 2 to 7, only one outlet pipe 10 is provided, accordingly only one outlet opening 9 is also present in this case. Preferably, the silencer 1 comprises exactly one inlet opening 7 and exactly one inlet pipe 8 as well as exactly two outlet openings 9 and exactly two outlet pipes 10.

The shell 3 is segmented in the circumferential direction 5, so that it comprises at least two shell segments 11, 12. The one shell segment 11 comprises the inlet opening 7 and is described in the following as inlet shell segment 11. The other shell segment 12 comprises the at least one outlet opening 9 and is described in the following as outlet shell segment 12. In the case of the embodiments introduced here, the shell 3 has exactly two shell segments each, which are each configured as separate components. In the assembled state, which is reflected in the FIGS. 1 and 2, the two shell segments 11, 12 are joined to one another in a fixed and gas-tight manner. Practically, all inlet openings 7 are formed in the inlet shell segment 11, while all outlet openings 9 are formed in the outlet shell segment 12.

According to the embodiments shown here, the shell segments 11, 12 can have a collar 13 each for the respective shell openings 7, 9, which collar 13 with respect to the remaining outer contour of the respective shell segment 11, 12 projects to the outside and surrounds the receptive shell opening 7, 9. The respective collar 13 in this case is integrally moulded on the respective shell segment 11, 12. The respective shell segment 11, 12 can be designed in particular as a formed sheet metal part, preferentially as a deep-drawn part.

The inlet pipe 8 assigned to the inlet opening 7 is coaxially inserted into the inlet opening 7 from the inside. In particular, the inlet pipe 8 coaxially projects into the associated collar 13. In this case, the inlet pipe 8 practically terminates approximately flush with the associated collar 13. In the assembled state, the inlet pipe 8 can be joined to the associated collar 13 in a fixed manner. To this end, an annular, closed circumferential weld seam is appropriate. Analogously to this, the outlet pipe 10 assigned to the respective outlet opening 9 is coaxially inserted into the associated outlet opening 9 from the inside. In this case, too, the respective outlet pipe 10 coaxially projects into the associated collar 13. In this case, too, the outer pipe 10 practically terminates approximately flush with the associated collar 13. In the assembled state, the respective outer pipe 10 is joined to the associated collar 13 in a fixed manner, wherein an annular, closed circumferential weld seam is also appropriate in this case. The weld seams for fixing the pipes 8, 10 to the collar 13 of the associated openings 7, 9 and with a pipe 8, 10 for example projecting slightly over the respective collar 13, can join a face end of the collar 13 to the outside of the respective pipe 8, 10. The respective shell segment 11, 12 is practically produced from one piece.

In the embodiment shown in FIG. 1, the inlet pipe 8 and the two outlet pipes 10 are each angled L-shaped, so that the inlet pipe 8 comprises a first leg 24 and a second leg 25 and the two outlet pipes 10 each comprise a first leg 26 and a second leg 27 each. The first leg 24 of the inner pipe 8 is inserted into the inlet opening 7 from the inside. The second leg 25 of the inlet pipe 8 is rotatably arranged about its longitudinal center axis 28, which substantially extends parallel to the axial direction 4. The first legs 26 of the two outlet pipes 10 are each inserted into the outlet openings 9 from the inside. The second legs 27 of the outlet pipes 10 are each rotatably arranged about their longitudinal center axes 29, which likewise extend substantially parallel to the axial direction 4.

The inlet pipe 8 is rotatably mounted about the longitudinal center axis 28 of its second leg 25 on the first lower intermediate base 16, for example by means of a sliding seat. The two outlet pipes 10 are rotatably mounted about the longitudinal center axis 29 of their second legs 27 at least on one of the intermediate bases 16, preferentially on both intermediate bases 16, for example in sliding seats.

Since, in the embodiment shown here, all inlet pipes 8 are inserted into an inlet opening 7 penetrating the shell 3 and all outlet pipes 10 are each additionally inserted in an outlet opening 9 penetrating the shell 3, the two end bases 6 can be configured completely closed, so that they have no axial opening.

Practically, the respective inlet opening 7 on the one hand and the respective outlet opening 9 on the other hand are located diametrically opposite one another on the shell 3.

The respective inlet pipe 8 and the respective outlet pipe 10 are constituent parts of a silencer insert 15, which is arranged in the interior 23 of the housing 2.

The housing 2 in this case encloses an interior 23, which in the circumferential direction 5 is surrounded by the shell 3 and which in the axial direction 4 is limited by the end bases 6.

In the embodiment shown in FIG. 1, the two end bottoms 6 form separate components with respect to the silencer insert 15. The silencer insert 15 in turn comprises two intermediate bases 16, namely a first intermediate base 16 shown in FIG. 1 at the bottom and a second intermediate base 16 shown in FIG. 1 at the top. The first, lower intermediate base 16 axially limits first chamber 30 with the first, lower end base 6. The first, lower intermediate base 16 axially limits the second chamber 31 with the second, upper intermediate base 16. The second, upper intermediate base 16 axially limits a third chamber 32 with the second, upper end base 16.

The inlet opening 7 is positioned on the inlet shell segment 11 so that the inlet pipe 8 runs through the second chamber 31 and passing through the first, lower intermediate base 16 is fluidically connected to the first chamber 30. The inlet pipe 8 has no direct interaction with the third chamber 32. To this end, the inlet opening 7 is arranged in an axial portion of the shell 3 assigned to the second chamber 31. In contrast with this, the two outlet openings 9 are arranged in an axial portion of the shell 3 assigned to the third chamber 32. Accordingly, the two outlet pipes 10 are fluidically connected to the first chamber 30 through the third chamber 32, passing through the second, upper intermediate base 16, through the second chamber 31 and passing through the first, lower intermediate base 16.

In this case, the silencer insert 15 additionally comprises a connecting pipe 33, which extends through the second chamber 31 and at least passing through the first, lower intermediate base 16 in the example is fluidically connected to the first chamber 30. Additionally or alternatively, the intermediate pipe 33 can also be fluidically connected to the third chamber 32 by passing through the second, upper intermediate base 16.

In this case, the inlet pipe 8 is provided with a perforation 34 in the second chamber 31. In this case, the two outlet pipes 10 are exclusively provided with a perforation 35 within the third chamber 32. The connecting pipe 33 is exclusively provided with a perforation 36 in the second chamber 31. The second chamber 31 can be filled with a sound absorption material or sound absorption means which is not shown here. Likewise, the third chamber 32 can be filled with a sound absorption material or a sound absorption means. Alternatively, it is likewise possible to form the third chamber 32 as a resonance chamber of a Helmholtz resonator, whose neck can be formed through the connecting pipe 33. In this case, the connecting pipe 33 penetrates both intermediate bases 16.

In the following, a method for producing the silencer 1 is discussed in more detail making reference to the FIGS. 3 to 7. Here, further features of the silencer 1 are explained in more detail.

Figure 3:
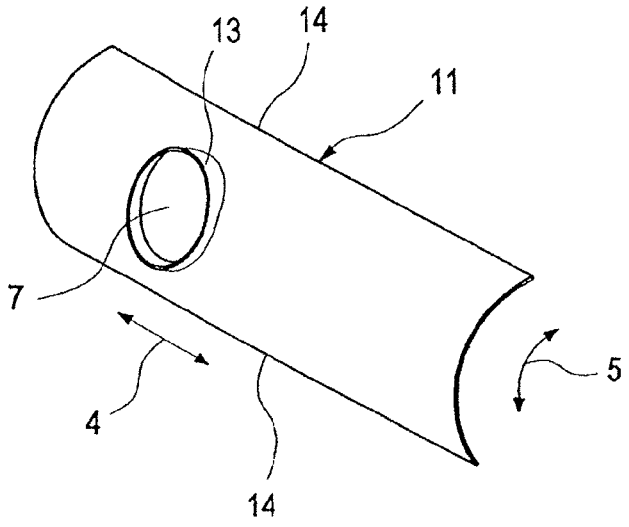
FIG. 3 is a perspective view of an inlet shell segment.

According to FIG. 3, the inlet shell segment 11 is produced separately from the outlet shell segment 12 or separated from the latter. In any case, the two shell segments 11, 12 are separate components after their production. In this case, a one-piece production of the respective shell segment 11, 12 as formed sheet metal part is preferred. Noticeably, the respective collar 13 is integrally molded onto the respective shell segment 11, 12 in this case, for example as a passage. The inlet shell segment 11 practically extends over between 10% and 40% of the total circumference of the shell 3. In the example, the inlet shell segment 11 extends over approximately 20% of the total circumference of the shell 3. As a consequence, the outlet shell segment 12 extends over more than 180° of the total circumference of the shell 3.

Circumferential ends 14 of the inlet shell segment 11 extend linearly and preferably parallel to the axial direction 4 of the silencer 1.

Figure 4:
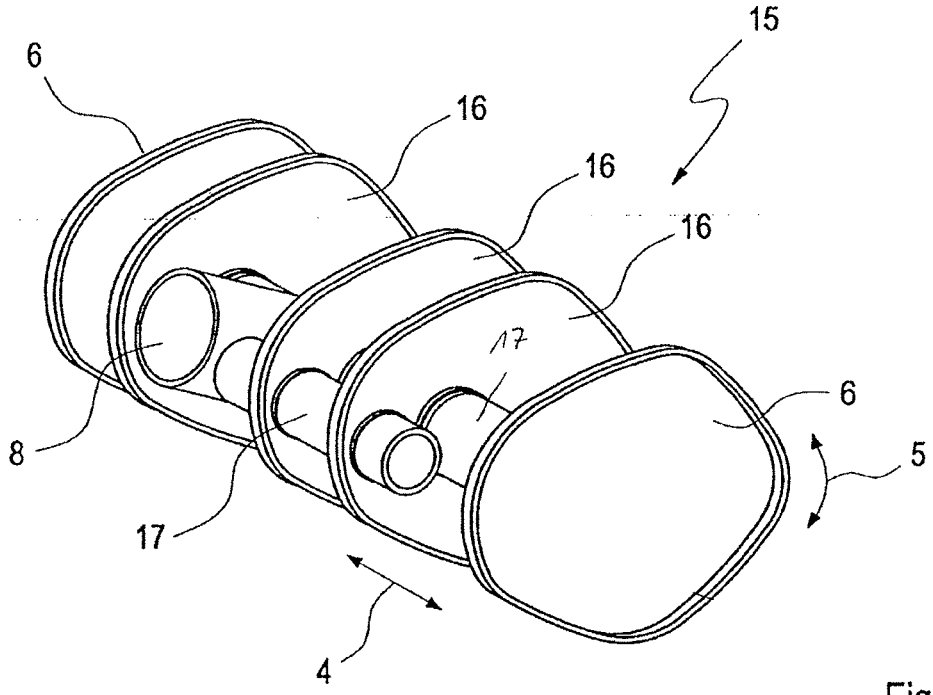
FIG. 4 is a perspective view of an arrangement of a silencer insert and two end bases.

The insert 15 shown in FIG. 4 is produced separately from the inlet shell segment 11 and separately from the outlet shell segment 12, which insert 15 comprises at least the inlet pipe 8 and at least one outlet pipe 10. In the example of the FIGS. 2 to 7, the insert 15 can also comprise the two end bases 6. In FIG. 4, a comparatively complex silencer insert 15 is reproduced purely exemplarily, which in this case comprises three intermediate bases 16. Furthermore, coupling pipes 17 can be provided. It is clear that the insert 15 shown in FIG. 4 can also comprise at least one connecting pipe 33. In this case, too, it is possible with the help of the intermediate bases 16, to form a plurality of chambers in the interior 23 of the housing 2, which can be configured as reflection chamber, absorption chamber and resonance chamber as well as any combinations thereof. The silencer insert 15 is completely preassemblable by itself. In the embodiment of the FIGS. 2 to 7, the insert 15 is preassemblable together with the end bases 6.

Figure 5:
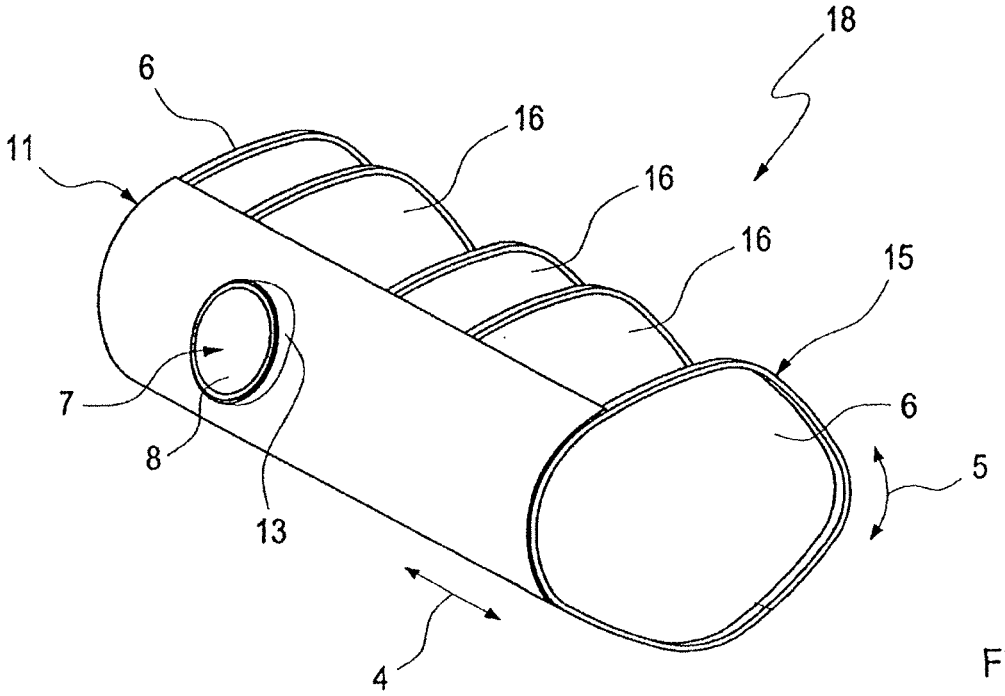
FIG. 5 is a perspective view of a prefabricated unit of the silencer.

According to FIG. 5, the completely preassembled silencer insert 15 can be joined to the inlet shell segment 11 in order to form a unit 18, which is completely preassemblable. The assembly of the inlet shell segment 11 to the insert 15 proves to be comparatively simple since in particular position tolerances can be offset in a particularly simple manner. This can be supported in particular in that the inlet pipe 8 is rotatably mounted about the longitudinal center axis 28 of its second leg 25, as a result of which the orientation of the first leg 24 is adjustable.

Furthermore, the inlet pipe 8 can be inserted into and in particular inserted through the inlet opening 7 and accordingly can be particularly easily connected to the associated collar 13. In this case, too, the end bases 6 can be simply connected to the inlet shell segment 11, wherein shape tolerances and position tolerances can also be easily offset in this case.

From FIG. 5 it is evident that with this unit 18 an inside of the inlet shell segment 11 facing the interior 23 of the housing 2 is easily accessible because of the absent outlet shell segment 12. Consequently, for example the intermediate bases 16 can be fastened to the inlet shell segment 11 from the inside. For example, the intermediate bases 16 can be welded to the inside of the inlet shell segment 11. Because of this, the unit 18 is given a particularly high stability.

Figure 6:
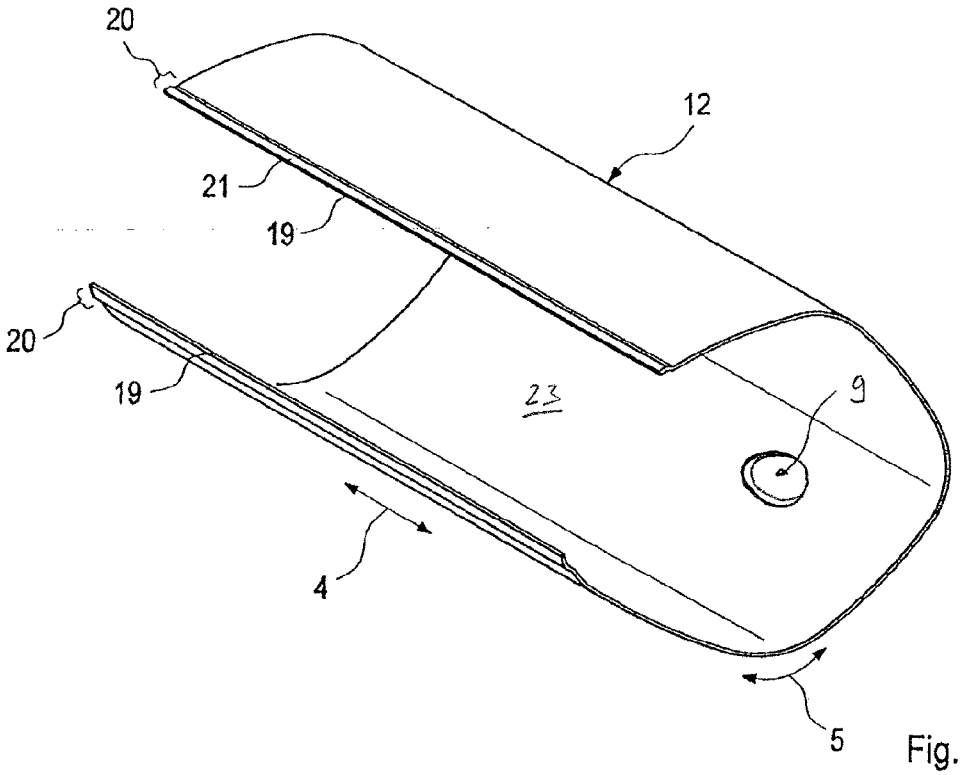
FIG. 6 is a perspective view of the outlet shell segment.

According to FIG. 6, the outlet shell segment 12 is produced separately from the inlet shell segment 11 and separately from the insert 15. Preferably, the insert 15 is likewise a formed sheet metal part, which is practically produced from one piece. The outlet shell segment 12 likewise has linear circumferential ends 19 complementarily to the inlet shell segment 11, which practically extend parallel to the axial direction 4 of the silencer 1. Particularly advantageous in this case is an embodiment, in which the outlet shell segment 12 is dimensioned larger in the circumferential direction 5 than the difference between total circumference of the shell 3 and the circumferential component of the inlet shell segment 11.

Because of this, an overlap region 20 each can be realized on the circumferential ends 19 of the outlet shell segment 12, which in the assembled state radially outside overlaps the inlet shell segment 11 on its circumferential ends 14 in the circumferential direction 5. In order to be able to realize this overlap as gas-tight as possible or as easily as possible, the inlet shell segment 11 or, as is the case here, the outlet shell segment 12 on each of its circumferential ends 19 can comprise an edge 21 that is stepped towards the outside. The step height of the stepped edge 21 in this case is matched to the material thickness of the inlet shell segment 11. The overlap region 20 additionally makes possible tolerance offsetting when assembling the outlet shell segment 12.

Figure 7:
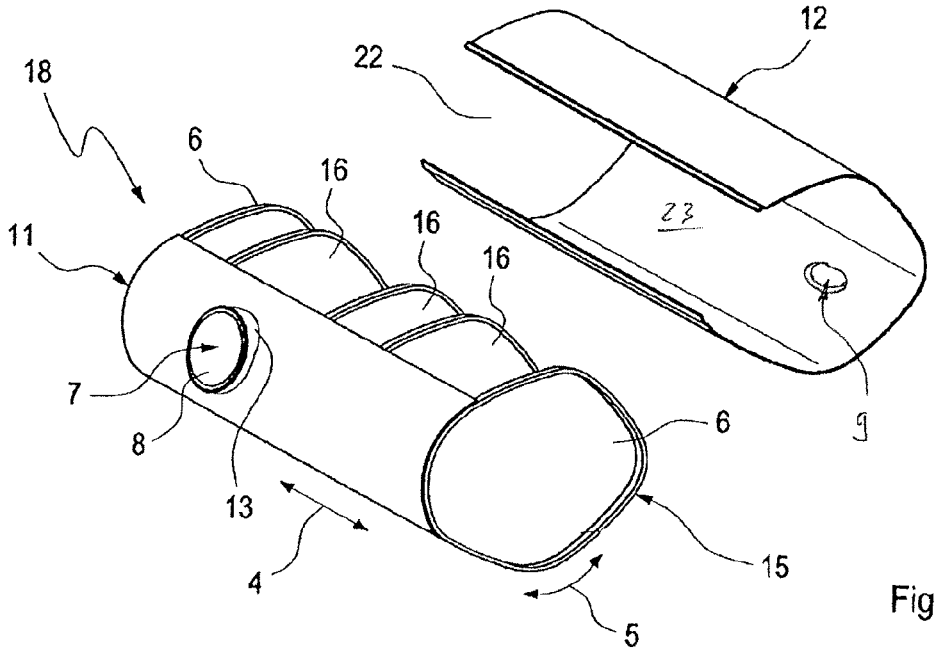
FIG. 7 is a perspective view of the silencer on assembling the outlet shell segment to the preassembled unit.

According to FIG. 7, the outlet shell segment 12, which can be pre-formed according to the circumferential contour of the shell 3 or corresponding to the circumferential contour of the unit 18, is attached to the unit 18. To this end, the outlet shell segment 12 can be attached transversely to the axial direction 4, wherein an open side 22 of the outlet shell segment 12 formed through the absent inlet shell segment 11 can be put over the unit 18. This is easily possible through the flexibility of the shell material used. In this case, the outlet shell segment 12 is positioned on the unit 18 so that the overlap regions 20 overlap the circumferential ends 14 of the inlet shell segment 11. Following this, the outlet shell segment 12 is fastened. For example, the outlet shell segment 12 can be joined along the stepped edges 21 to the inlet shell segment 11 in a fixed manner. For example, a weld seam applied from the outside can be provided. Furthermore, the outlet shell segment 12 is joined to the end bases 6 in a fixed manner for example by means of weld seams. In addition to this, the outlet shell segment 12 can be additionally joined to at least one of the intermediate bottoms 16 in a fixed manner from the outside. For example, tack welds applied from the outside can connect the outlet shell segment 12 from the outside to the intermediate bases 16 arranged on the inside.

When attaching the outlet shell segment 12, the outlet pipes 10 are inserted into the outlet openings 9 with their first legs 26 from the inside, so that they project into the associated collars 13 or even project through and beyond these. Through the rotatability of the outlet pipes 10 about the respective center axis 29 of the second legs 27, a tolerance offset can also be carried out in this case.

Figure 2:
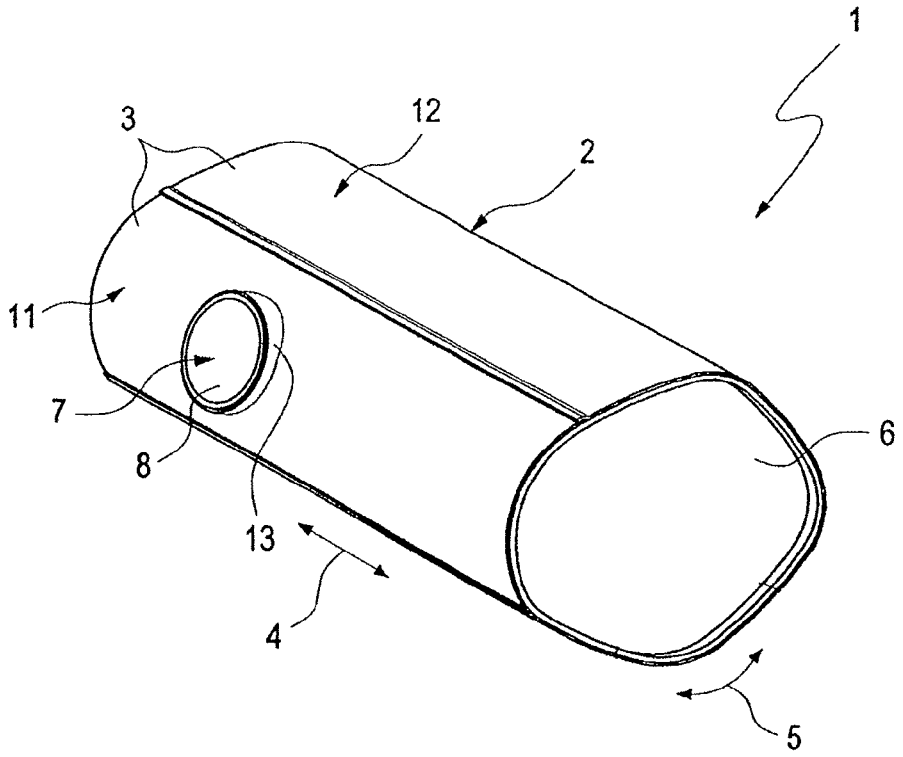
FIG. 2 is a perspective view of the silencer with another view direction.

Following the attachment of the outlet shell segment 12, the silencer 1 then reflects what is shown according to the FIGS. 1 and 2.

It is clear that the assembly operation described above can also be modified to the effect that the outlet shell segment 12 is first attached to the silencer insert 15 and the inlet shell segment 11 is attached to the unit 18 formed through the insert 15 and the outlet shell segment 12 thereafter.

Through the segmenting of the shell 3 in the circumferential direction 5 it is additionally possible to vary the material thicknesses and/or wall thicknesses of the shell 3 in the individual segments. Thus, the inlet shell segment 11 and the outlet shell segment 12 can have different wall thicknesses. For example, the inlet shell segment 11 has a greater wall thickness that the outlet shell segment 12. In the example, the wall thickness of the inlet shell segment 11 can be at least 50% or at least twice as large as the wall thickness of the outlet shell segment 12. Because of this, the inlet shell segment 11 can for example be provided with a greater dimensional stability, which increases the stiffness unity 18. At the same time, the silencer 1 is optimized with respect to weight and production costs. Additionally or alternatively, it is possible to use different materials for the inlet shell segment 11 and the outlet shell segment 12. An adaptation to different requirements, such as for example strength, stiffness can also be accomplished because of this.

Additionally or alternatively, it is relatively easily possible through the segmenting to provide the respective shell segment 11, 12 with stiffening beads which are not shown here. Because of this, the stability of the shell 3 or of the housing 2 can be significantly increased. These beads extend for example in circumferential direction 5. They can be arranged in particular so that they can be utilized for positioning the intermediate bases 16 and/or the end bases 6, for example in the form of groove-like depressions on the inside of the inlet shell segment 11 or of the outlet shell segment 12.

While specific embodiments of the invention have been shown and described in detail to illustrate the application of the principles of the invention, it will be understood that the invention may be embodied otherwise without departing from such principles.

The invention claimed is:

1. A silencer for an exhaust system of an internal combustion engine, the silencer comprising:

a housing comprising a circumferential shell that has an outer shell surface which is closed in a circumferential direction, an end base on each of two longitudinal ends of the outer shell surface, each end base being distant from another in an axial direction and each end base is continuous without any interruption and without any opening therethrough, the circumferential shell comprising:

an inlet shell segment with an inlet shell peripheral surface having an axial extent from one of the two longitudinal ends to another of the two longitudinal ends and having a peripheral extent from an inlet segment first circumferential end to an inlet segment second circumferential end and comprising an inlet opening in the inlet shell peripheral surface;

an outlet shell segment with an outlet shell peripheral surface having an axial extent from one of the two longitudinal ends to another of the two longitudinal ends and having a peripheral extent from an outlet segment first circumferential end to an outlet segment second circumferential end and comprising an outlet opening in the outlet shell peripheral surface;

a first segment end connection of the inlet shell segment to the outlet shell segment with the inlet segment first circumferential end at or adjacent to the outlet segment first circumferential end; and a second segment end connection of the inlet shell segment to the outlet shell segment with the inlet segment second circumferential end at or adjacent to the outlet segment second circumferential end; and a silencer insert arranged in the housing, the silencer insert comprising an inlet pipe for exhaust gas and an outlet pipe or exhaust gas, wherein the inlet pipe is inserted from the inside through the inlet opening, and the outlet pipe is inserted from the inside through the outlet opening.

2. The silencer according to claim 1, wherein:

the silencer insert further comprises at least one additional inlet pipe to provide a plurality of inlet pipes and at least one additional outlet pipe to provide a plurality of outlet pipes; and all of the plurality of inlet pipes and all of the plurality of outlet pipes of the silencer insert are inserted into respective inlet openings and outlet openings from the inside.

3. The silencer according to claim 1, wherein:

at least one of the inlet pipe and the outlet pipe is angled as an L-shaped pipe; and a first leg of the L-shaped pipe is inserted into the respective opening and a second leg of the L-shaped pipe is arranged, on the silencer insert, rotatably about a longitudinal center axis.

4. The silencer according to claim 1, wherein the at least one inlet opening and the at least one outlet opening are located diametrically opposite one another.

5. The silencer according to claim 1, wherein:

at least one of the end bases has an outward curvature, which in the housing limits an additional volume, which axially enlarges an interior of the housing, to extend axially beyond the shell.

6. The silencer according to claim 5, wherein:

the inlet shell segment and the outlet shell segment are the only shell segments and form an entirety of the outer shell surface and wherein at least one of:

the the first segment end connection comprises a weld seam and the second segment end connection comprises a weld seam;

each of the inlet segment first circumferential end, the inlet segment second circumferential end, the outlet segment first circumferential end and the outlet segment second circumferential end extend linearly and parallel to the axial direction;

the two shell segments radially overlap in the region of circumferential ends at each of the first segment end connection and the second segment end connection; and one shell segment is radially inserted into the other shell segment.

7. The silencer according to claim 1, wherein:

the silencer insert comprises two intermediate bases;

a first intermediate base axially limits a first chamber with the first end base;

the first intermediate base axially limits a second chamber with a second intermediate base;

the second intermediate base axially limits a third chamber with a second end base;

the inlet pipe runs through the second chamber and passes through the first intermediate bottom and is fluidically connected to the first chamber;

the outlet pipe is fluidically connected to the first chamber, runs through the third chamber, passing through the second intermediate base, through the second chamber and passing through the first intermediate base.

8. The silencer according to claim 7, wherein at least one of:

the silencer insert further comprises a connecting pipe, which extends through the second chamber and which passes through at least one of the intermediate bases and is fluidically connected to at least one of the other chambers;

the inlet pipe is perforated within a region of the second chamber;

the outlet pipe is perforated within a region of at least one of the second chamber and the third chamber;

the connecting pipe is perforated in the second chamber; and at least one of the second chamber and the third chamber is filled with a sound absorption means.

9. The silencer according to claim 5, wherein one of the shell segments extends over more than 180° in circumferential direction.

10. A method for producing a silencer comprising the steps of:

providing a silencer insert comprising an inlet pipe for exhaust gas and an outlet pipe for exhaust gas;

providing an inlet shell segment with an inlet shell peripheral surface having an axial extent and having a peripheral extent from an inlet segment first circumferential end to an inlet segment second circumferential end and comprising an inlet opening in the inlet shell peripheral surface providing an outlet shell segment with an outlet shell peripheral surface having an axial extent and having a peripheral extent from an outlet segment first circumferential end to an outlet segment second circumferential end and comprising an outlet opening in the outlet shell peripheral surface, into which the outlet pipe is inserted from the inside;

radially inserting the silencer insert into the inlet shell segment or into the outlet shell segment, wherein the inlet pipe is inserted into the outlet opening from the inside or the outlet pipe is inserted into the outlet opening from the inside, radially attaching the outlet shell segment first circumferential end to the inlet shell segment first circumferential end to join the outlet shell segment first circumferential end to the inlet shell segment first circumferential end and radially attaching the inlet shell segment second circumferential end to the outlet shell segment second circumferential end to join the inlet shell segment second circumferential end to the outlet shell segment second circumferential end, wherein the step of radially attaching includes inserting the outlet pipe into the outlet opening from the inside or inserting the inlet pipe into the inlet opening from the inside;

providing an end base for each of two longitudinal shell ends, distant from each other in an axial direction, each of the end bases being continuous without any interruption and without any opening therethrough; and attaching each end base to longitudinal shell ends of the outlet shell segment and the inlet shell segment.

11. A method according to claim 10, wherein:

the silencer insert further comprises at least one additional inlet pipe to provide a plurality of inlet pipes and at least one additional outlet pipe to provide a plurality of outlet pipes; and all of the plurality of inlet pipes and all of the plurality of outlet pipes of the silencer insert are inserted into respective inlet openings and outlet openings from the inside.

12. A method according to claim 10, wherein:

at least one of the inlet pipe and the outlet pipe is angled as an L-shaped pipe;

a first leg of the L-shaped pipe is inserted into the respective opening and a second leg of the L-shaped pipe is arranged, on the silencer insert to rotate about a longitudinal center axis.

13. A method according to claim 10, wherein the inlet opening and the outlet opening are located diametrically opposite one another.

14. A method according to claim 10, wherein at least one of the end bases has an outward curvature, which in the housing limits an additional volume, which axially enlarges an interior of the housing, to extend axially beyond the shell.

15. A method according to claim 14, wherein:

the inlet shell segment and the outlet shell segment are the only shell segments and form an entirety of the outer shell surface and wherein at least one of:

the the first segment end connection comprises a weld seam and the second segment end connection comprises a weld seam;

each of the inlet segment first circumferential end, the inlet segment second circumferential end, the outlet segment first circumferential end and the outlet segment second circumferential end extend linearly and parallel to the axial direction;

the two shell segments radially overlap in the region of circumferential ends at each of the first segment end connection and the second segment end connection; and one shell segment is radially inserted into the other shell segment.

16. A method according to claim 10, wherein:

the silencer insert comprises two intermediate bases;

a first intermediate base axially limits a first chamber with the first end base;

the first intermediate base axially limits a second chamber with a second intermediate base;

the second intermediate base axially limits a third chamber with a second end base;

the inlet pipe runs through the second chamber and passes through the first intermediate bottom and is fluidically connected to the first chamber;

the outlet pipe is fluidically connected to the first chamber through the third chamber, passing through the second intermediate base, through the second chamber and passing through the first intermediate base.

17. A method according to claim 16, wherein at least one of:

the silencer insert further comprises a connecting pipe, which extends through the second chamber and which passing through at least one of the intermediate bases and is fluidically connected to at least one of the other chambers;

the inlet pipe is perforated in the second chamber;

the outlet pipe is perforated in at least one of the second chamber and in the third chamber;

the connecting pipe is perforated in the second chamber; and at least one of the second chamber and the third chamber is filled with a sound absorption means.

18. A method according to claim 14, wherein one of the shell segments extends over more than 180° in the circumferential direction.

* * * * *